US005945896A

United States Patent [19]

Miyamoto

[11] Patent Number: 5,945,896

[45] Date of Patent: Aug. 31, 1999

[54] DIELECTRIC FILTER

[75] Inventor: Hirofumi Miyamoto, Kanazawa, Japan

[73] Assignee: Muarata Manufacturing Co., Ltd., Japan

[21] Appl. No.: 09/005,541

[22] Filed: Jan. 12, 1998

[30] Foreign Application Priority Data

Jan. 13, 1997 [JP] Japan ..... 9-004001
Nov. 27, 1997 [JP] Japan ..... 9-326458

[51] Int. Cl.[6] ..... H01P 1/205; H01P 7/04

[52] U.S. Cl. ..... 333/206; 333/222

[58] Field of Search ..... 333/202, 206, 333/207, 222, 223

[56] References Cited

U.S. PATENT DOCUMENTS 5,712,648 1/1998 Tsujiguchi ..... 333/134 X
5,764,118 6/1998 Saito et al. ..... 333/206

FOREIGN PATENT DOCUMENTS 0664572 7/1995 European Pat. Off. .
0731522 9/1996 European Pat. Off. .

OTHER PUBLICATIONS

Patent Abstracts of Japan, vol. 17, No. 676 (E–1475), Dec. 13, 1993 & JP 05 226909 A (Sony Chem Corp.) Sep. 3, 1993, abstract; figure 3.

*Primary Examiner*—Seungsook Ham
*Attorney, Agent, or Firm*—Ostrolenk, Faber, Gerb & Soffen, LLP

[57] ABSTRACT

Stronger electromagnetic coupling than in conventional devices can be provided between adjacent resonator holes in a dielectric filter or a dielectric duplexer without changing the external shape and dimensions of a dielectric block. Resonator holes pass through opposing surfaces of a dielectric block, each including a large-diameter hole section and a small-diameter hole section. The small-diameter hole sections may be formed near a short-circuit end face of the dielectric block. The large-diameter hole sections and the small-diameter hole sections are connected to each other with their axes shifted from each other. The radius R of the large-diameter hole sections, the radius r of the small-diameter hole sections, and the shift distance P between the axes of the large-diameter hole sections and those of the small-diameter hole sections satisfy the expression R−r<P<R+r.

17 Claims, 10 Drawing Sheets

DIELECTRIC FILTER

BACKGROUND OF THE INVENTION

1. Field of the Invention

The present invention relates to dielectric filters and dielectric duplexers, and more particularly, to dielectric filters and dielectric duplexers in which a plurality of dielectric resonators are provided in a single dielectric block.

2. Related Art

A known dielectric filter in which a plurality of dielectric resonators are provided in a single dielectric block is shown in FIG. 18. In this dielectric filter, two resonator holes 32*a* and 32*b* pass through opposing surfaces 31*a* and 31*b* of a dielectric block 31. The resonator holes 32*a* and 32*b* have large-diameter hole sections 42*a* and 42*b*, and small-diameter hole sections 43*a* and 43*b* connecting to the large-diameter hole sections 42*a* and 42*b*. The axes of the small-diameter hole sections 43*a* and 43*b* are eccentrically shifted from those of the large-diameter hole sections 42*a* and 42*b*. In other words, as shown in FIG. 19, the axes of the small-diameter hole sections 43*a* and 43*b* are shifted a distance P from those of the large-diameter hole sections 42*a* and 42*b* wherein P is within a range defined by $0<P\leqq R-r$, where R indicates the radius of the large-diameter hole section 42*a* and 42*b*, r indicates the radius of the small-diameter hole section 43*a* and 43*b*, and P indicates the shift distance between the respective axes of the large-diameter hole sections 42*a* and 42*b* and those of the small-diameter hole sections 43*a* and 43*b* (see FIG. 19).

An outer conductor 34 is formed on almost all the outer surface of the dielectric block 31. One pair of input and output electrodes 35 is formed on the outer surface of the dielectric block 31. The pair of electrodes 35 are not electrically connected to the outer conductor 34 because of a gap maintained between them. Inner conductors 33 are formed on almost all the surface inside the resonator holes 32*a* and 32*b*. Gaps 38 are provided between the inner conductors 33 and the portions of the outer conductor 34 extending into the openings of the large-diameter hole sections 42*a* and 42*b*.

In the known dielectric filter having the structure described above, as shown in FIG. 19, when the distance d1 between the axes of the small-diameter hole sections 43*a* and 43*b* is set longer than the distance d2 between the axes of the large-diameter hole sections 42*a* and 42*b*, the electromagnetic coupling between the resonator holes 32*a* and 32*b* becomes capacitive coupling. Conversely, when the distance d1 between the axes of the small-diameter hole sections 43*a* and 43*b* is set shorter than the distance d2 between the axes of the large-diameter hole sections 42*a* and 42*b*, the electromagnetic coupling between the resonator holes 32*a* and 32*b* becomes inductive coupling. The level of the electromagnetic coupling between the resonator holes 32*a* and 32*b* is set to the desired strength by changing the distance d1 between the axes of the small-diameter hole sections 43*a* and 43*b*.

However, since the axes of the small-diameter hole sections 43*a* and 43*b* are shifted eccentrically to those of the large-diameter hole sections 42*a* and 42*b* only in a range of $0<P\leqq R-r$ in the conventional dielectric filter, the range over which the distance d1 between the axes of the small-diameter hole sections 43*a* and 43*b* can be varied is narrow. Therefore, the strength of the level of the electromagnetic coupling between the adjacent resonator holes 32*a* and 32*b* cannot be varied over a wide range. Consequently, when a stronger electromagnetic coupling is required between the adjacent resonator holes 32*a* and 32*b*, the external shape and dimensions of the dielectric block 31 need to be changed.

SUMMARY OF THE INVENTION

Accordingly, there is a need to provide a dielectric filter and a dielectric duplexer in which a strong electromagnetic coupling can be set between adjacent resonator holes without changing the external shape and dimensions of a dielectric block.

To achieve the foregoing, the present invention provides a dielectric filter and a dielectric duplexer, comprising a dielectric block, a plurality of resonator holes provided inside the dielectric block, inner conductors provided on the inner surfaces of the plurality of resonator holes, and an outer conductor formed on the outer surface of the dielectric block. At least one of the plurality of resonator holes has a large-diameter hole section, and a small-diameter hole section connected to said large-diameter hole section. The axis of said large-diameter hole section is shifted from the axis of said small-diameter hole section to form a bent-shaped hole, and the radius R of said large-diameter hole section, the radius r of said small-diameter hole section, and the shift distance P between the axis of said large-diameter hole section and the axis of said small-diameter hole section satisfy the expression $R-r<P<R+r$.

In the above dielectric filter and a dielectric duplexer, a plurality of the bent-shaped resonator holes may be formed adjacently, and the distance between the axes of the small-diameter hole sections in adjacent resonator holes may set to be longer than, shorter than, or equal to the distance between the axes of the large-diameter hole sections.

According to the dielectric filter and a dielectric duplexer of the present invention, the variable range of the distance between the axes of the small-diameter hole sections or of the distance between the axes of the large-diameter hole sections becomes wider than in the conventional dielectric filter and the dielectric duplexer. Therefore, when a strong electromagnetic coupling is required between adjacent resonator holes, the external shape or dimensions of the dielectric block do not need to be changed.

Since the axes of the small-diameter hole sections are shifted from those of the large-diameter hole sections in a range of $R-r<P<R+r$, where R indicates the radius of the large-diameter hole sections, r indicates the radius of the small-diameter hole sections, and P indicates the shift distance between the axes of the large-diameter hole sections and those of the small-diameter hole sections, the electromagnetic coupling between the resonator holes is made stronger than in the conventional dielectric filter and a dielectric duplexer can be made without changing the external shape and dimensions of the dielectric block. In addition, the attenuation pole formed at the lower frequency side (or the higher frequency side) of the passband can be moved in the lower-frequency direction (or the higher-frequency direction). A compact dielectric filter and dielectric duplexer having high performance and a steep attenuation characteristic can be readily made with a wider passband.

DETAILED DESCRIPTION OF EMBODIMENTS OF THE PRESENT INVENTION

Embodiments of dielectric filters and dielectric duplexers of the present invention will be described below by referring to the accompanying drawings.

Figure 1:
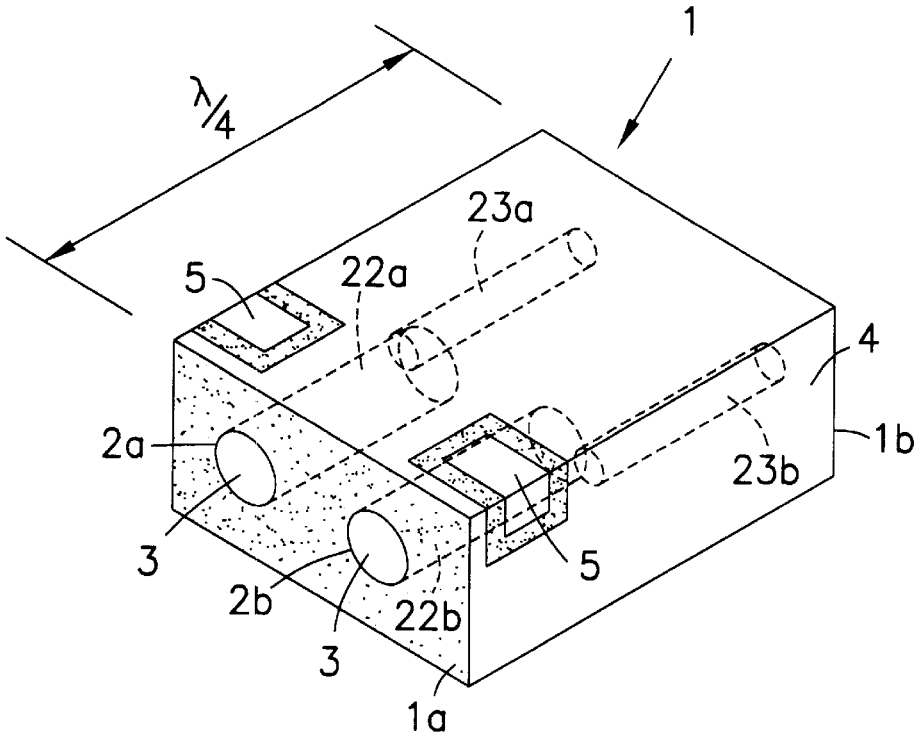
FIG. 1 is an external perspective view of a dielectric filter according to a first embodiment of the present invention.
Figure 2:
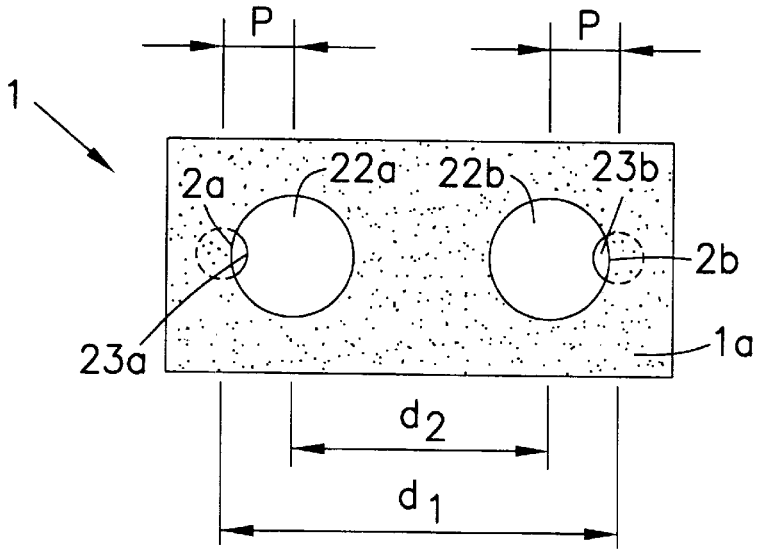
FIG. 2 is a view of an open end face of the dielectric filter shown in FIG. 1.
Figure 3:
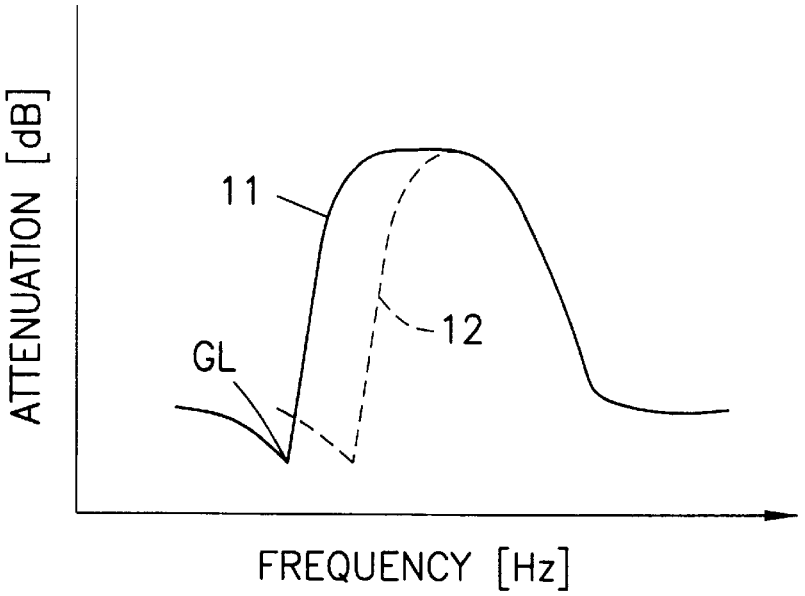
FIG. 3 is a graph showing the attenuation characteristic of the dielectric filter shown in FIG. 1.

First Embodiment (FIG. 1 to FIG. 3)

Figure 19:
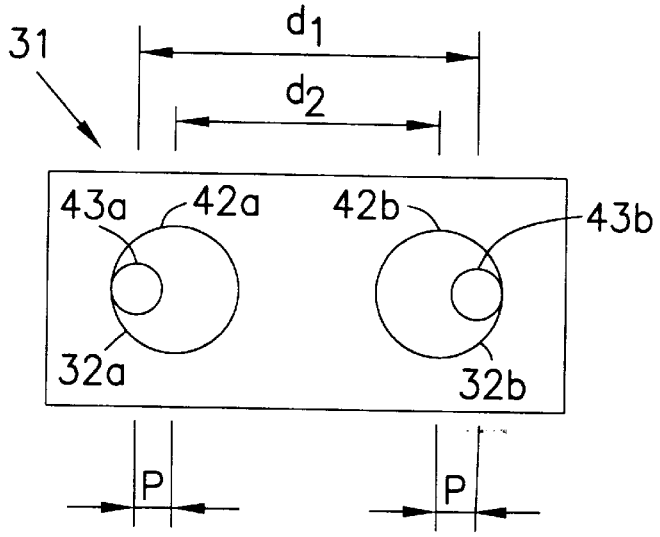
Fig. 19 PRIOR ART
FIG. 19 is an end view of the dielectric filter shown in FIG. 18 viewed from an open end face.

In a dielectric filter according to a first embodiment, as shown in FIG. 1, two resonator holes 2*a* and 2*b* passing through opposing surfaces 1*a* and 1*b* of a dielectric block 1 are formed. The resonator holes 2*a* and 2*b* include large-diameter hole sections 22*a* and 22*b* having a circular transverse cross section and small-diameter hole sections 23*a* and 23*b* having a circular transverse cross section and connecting to the large-diameter hole sections 22*a* and 22*b*. The small-diameter hole sections 23*a* and 23*b* are spaced away from each other with the axes of the small-diameter hole sections 23*a* and 23*b* being eccentrically shifted from those of the largediameter hole sections 22*a* and 22*b* in the direction away from each other. The axes of the small-diameter hole sections 23*a* and 23*b* are shifted away from those of the large-diameter hole sections 22*a* and 22*b* by a distance in a range defined by $R-r<P<R+r$, where R indicates the radius of the large-diameter hole sections 22*a* and 22*b*, r indicates the radius of the small-diameter hole sections 23*a* and 23*b*, and P indicates the shift distance between the axes of the large-diameter hole sections 22*a* and 22*b* and those of the small-diameter hole sections 23*a* and 23*b* (see FIG. 2). Therefore, the resonator holes 2*a* and 2*b* have bent shapes. The distance d1 between the axes of the small-diameter hole sections 23*a* and 23*b* is wider than the distance d2 between the axes of the large-diameter hole sections 22*a* and 22*b*, and further, the distance di is set wider than the distance between the axes of the small-diameter hole sections in the conventional dielectric filter shown in FIG. 19.

An outer conductor 4 and a pair of input and output electrodes 5 are formed on the outer surface of the dielectric block 1. The pair of input and output electrodes 5 are not electrically connected to the outer conductor 4 since a distance is maintained between them. The outer conductor 4 is formed on almost all the outer surface except for the area where the input and output electrodes 5 are formed and except for a surface 1*a* (hereinafter called an open end face 1*a*) on which the openings of the large-diameter hole sections 22*a* and 22*b* are disposed. Inner conductors 3 are formed on the entire surface inside the resonator holes 2*a* and 2*b*. The inner conductors 3 are electrically open (separated) from the outer conductor 4 at the open end face 1*a*, and are electrically short-circuited (connected) to the outer conductor 4 at a surface 1*b* (hereinafter called an short-circuit end face 1*b*) where the openings of the small-diameter hole sections 23*a* and 23*b* are disposed. The axial length of the resonator holes 2*a* and 2*b* is set to $\lambda/4$ (where $\lambda$ indicates the central wavelength of a resonator formed in each of the resonators 2*a* and 2*b*). Between the inner conductors 3 in the resonator holes 2*a* and 2*b* and the input and output electrodes 5, external coupling capacitors are generated.

In the dielectric filter having this structure, since the distance d2 between the axes of the large-diameter hole sections 22*a* and 22*b* of the resonator holes 2*a* and 2*b* is fixed at the open end face 1*a*, the amount of electric-field coupling energy coupling between the resonator holes 2*a* and 2*b* is hardly changed from that in the conventional dielectric filter. However, since the distance d1 between the axes of the small-diameter hole sections 23*a* and 23*b* is set longer than the distance d2 between the axes of the large-diameter hole sections 22*a* and 22*b* at the short-circuit end face 1*b*, the amount of magnetic-field coupling energy is reduced and the level of capacitive coupling is increased. In addition, since the distance d1 between the axes of the small-diameter hole sections 23*a* and 23*b* is set longer than in the conventional dielectric filter shown in FIG. 19, stronger capacitive coupling is obtained, so that two resonators formed in each of the resonator holes 2*a* and 2*b* are capacitively coupled strongly. Therefore, a dielectric filter having a stronger capacitive coupling is obtained without changing the external shape and dimensions of the dielectric block 1.

In general, in a dielectric filter in which a plurality of dielectric resonators is coupled, when the coupling between adjacent resonators is of a capacitive type, one attenuation pole GL is obtained at the lower-frequency side of the passband. This attenuation pole GL moves in the lower-frequency direction as the capacitive coupling becomes stronger. Therefore, as shown in FIG. 3, an attenuation pole GL (see a solid line 11) at the lower-frequency side of the passband of the dielectric filter according to the first embodiment is formed at a position lower in frequency than an attenuation pole GL (see a dotted line 12) of the conventional dielectric filter shown in FIG. 19. Thus, the passband of the dielectric filter according to the first embodiment is wider than that in the conventional dielectric filter.

Figure 4:
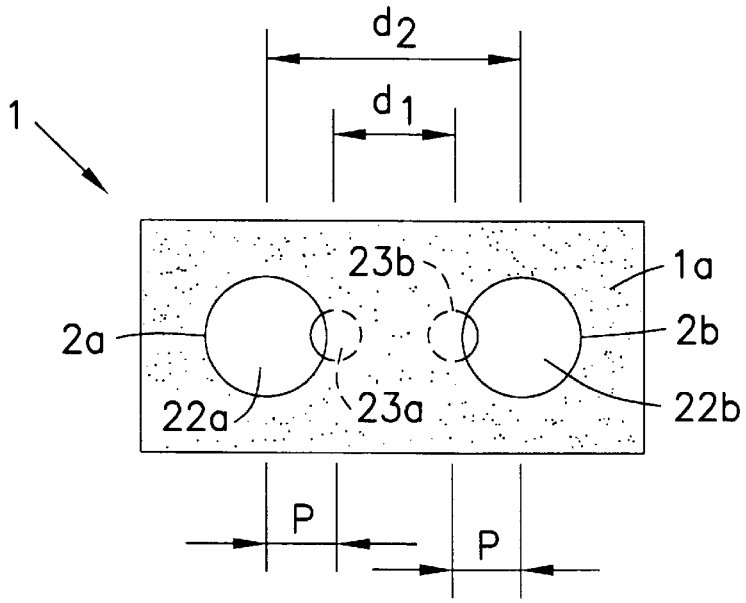
FIG. 4 is a view of a dielectric filter according to a second embodiment of the present invention.
Figure 5:
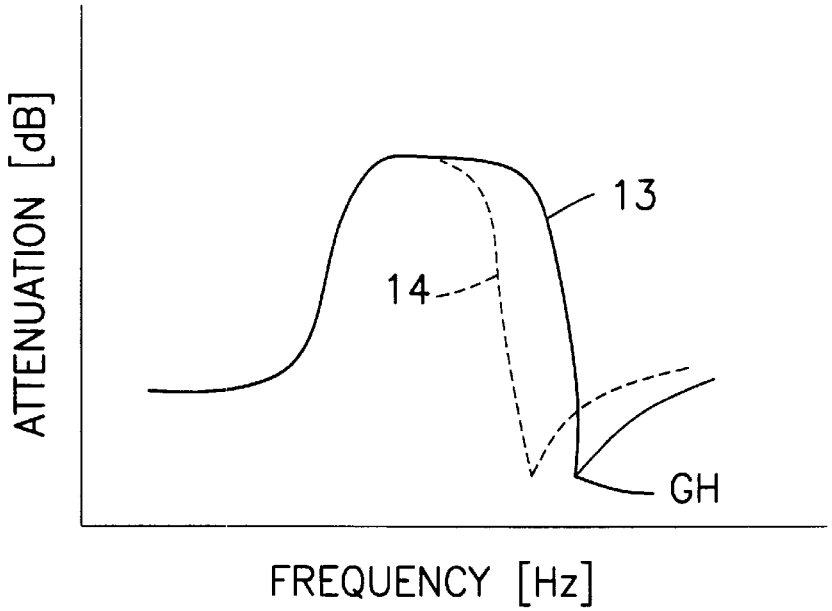
FIG. 5 is a graph showing the attenuation characteristic of the dielectric filter shown in FIG. 4.

Second Embodiment (FIG. 4 and FIG. 5)

As shown in FIG. 4, a dielectric filter according to a second embodiment has the same structure as the dielectric filter according to the first embodiment except that the distance d1 between the axes of the small-diameter hole sections 23*a* and 23*b* is shorter than the distance d2 between the axes of the large-diameter hole sections 22*a* and 22*b*, and is set shorter than the distance between the axes of the small-diameter hole sections in the conventional dielectric filter.

In the dielectric filter having this structure, since the distance d2 between the axes of the large-diameter hole sections 22*a* and 22*b* of the resonator holes 2*a* and 2*b* is fixed at the open end face 1*a*, the amount of electric-field energy related to the coupling between the resonator holes 2*a* and 2*b* is hardly changed from that in the conventional dielectric filter. However, since the distance d1 between the axes of the small-diameter hole sections 23*a* and 23*b* is set shorter than the distance d2 between the axes of the large-diameter hole sections 22*a* and 22*b* at the short-circuit end face 1*b*, the amount of magnetic-field energy related to the coupling is increased so that the level of inductive coupling is increased. In addition, since the distance d1 between the axes of the small-diameter hole sections 23*a* and 23*b* is set shorter than in the conventional dielectric filter, stronger inductive coupling is obtained, so that two resonators formed in each of the resonator holes 2*a* and 2*b* are inductively coupled strongly. Therefore, a dielectric filter having a stronger inductive coupling is obtained without changing the external shape and dimensions of the dielectric block 1.

In general, in a dielectric filter in which a plurality of dielectric resonators is coupled, when the coupling between adjacent resonators is of an inductive type, one attenuation pole GH is obtained at the higher-frequency side of the passband. This attenuation pole GH moves in the higher-frequency direction as the inductive coupling becomes stronger. Therefore, as shown in FIG. 5, an attenuation pole GH (see a solid line 13) at the higher-frequency side of the dielectric filter according to the second embodiment is formed at a position higher in frequency than an attenuation pole GH (see a dotted line 14) at the higher-frequency side of the conventional dielectric filter. The passband of the dielectric filter according to the second embodiment is made wider than in the conventional dielectric filter.

Figure 6:
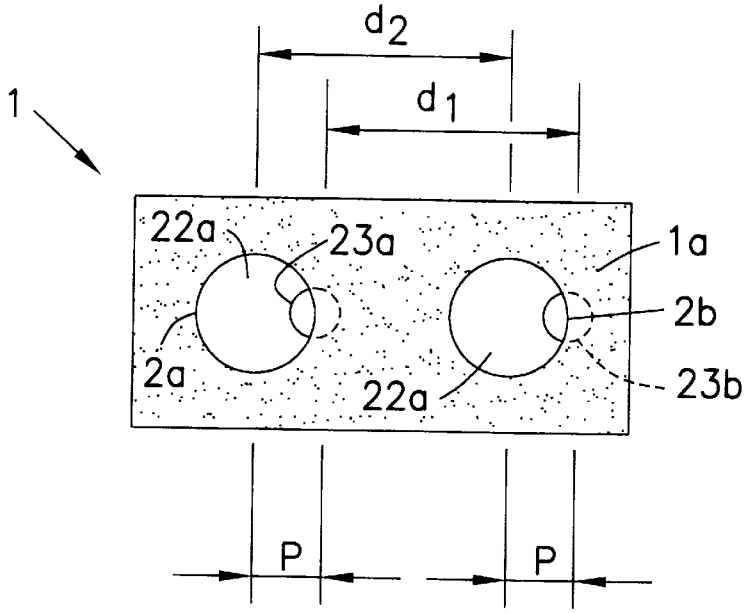
FIG. 6 is a view of a dielectric filter according to a third embodiment of the present invention.

Third Embodiment (FIG. 6)

As shown in FIG. 6, a dielectric filter according to a third embodiment has the same structure as the dielectric filter according to the first embodiment except that the distance d1 between the axes of the small-diameter hole sections 23*a* and 23*b* is set equal to the distance d2 between the axes of the large-diameter hole sections 22*a* and 22*b*. This dielectric filter provides a higher degree of freedom in designing the level of electromagnetic coupling.

Figure 7:
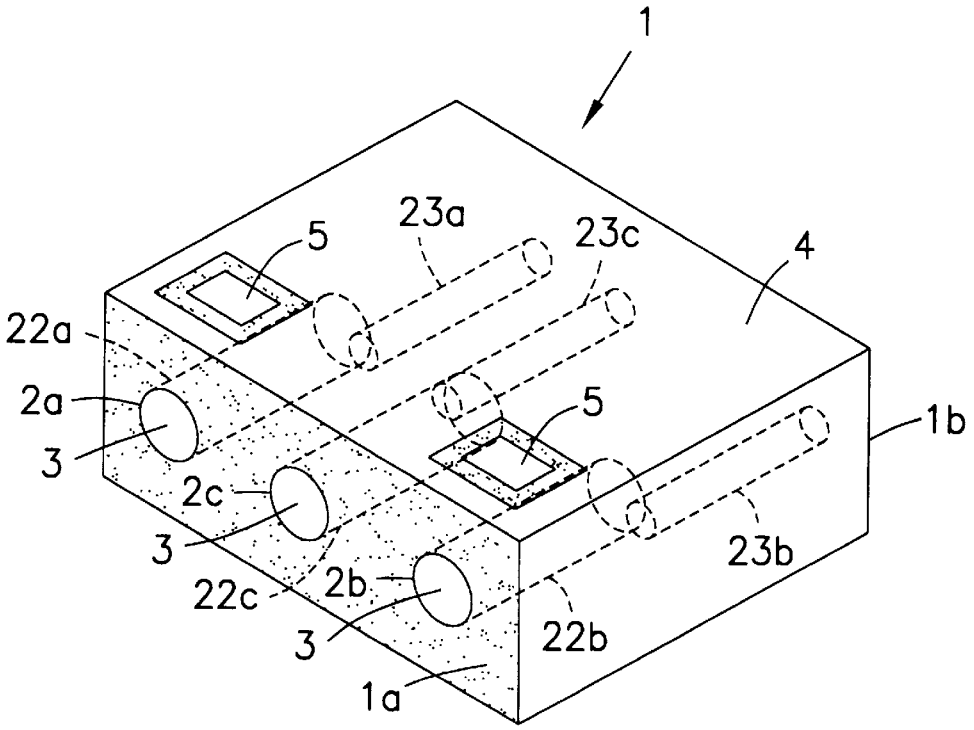
FIG. 7 is an external perspective view of a dielectric filter according to a fourth embodiment of the present invention.
Figure 8:
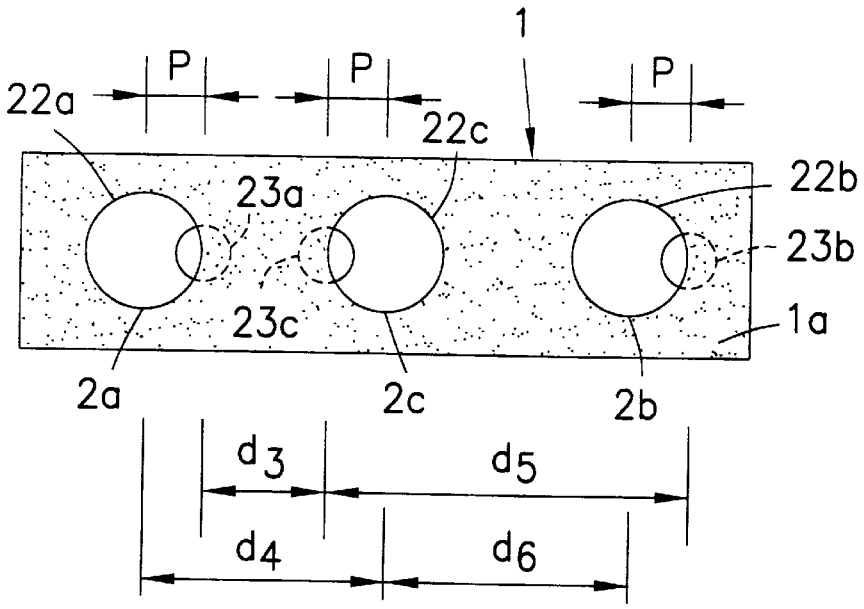
FIG. 8 is a view of an open end face of the dielectric filter shown in FIG. 7.

Fourth Embodiment (FIG. 7 and FIG. 8)

In a dielectric filter according to a fourth embodiment, as shown in FIG. 7, three resonator holes 2*a*, 2*b*, and 2*c* passing through an open end face 1*a* and a short-circuit end face 1*b* of a dielectric block 1 are formed in line. The resonator holes 2*a*, 2*b*, and 2*c* include large-diameter hole sections 22*a*, 22*b*, and 22*c* having a circular transverse cross section and small-diameter hole sections 23*a*, 23*b*, and 23*c* having a circular transverse cross section and connecting to the large-diameter hole sections 22*a*, 22*b*, and 22*c*. The axes of the small-diameter hole sections 23*a*, 23*b*, and 23*c* are eccentrically shifted from those of the large-diameter hole sections 22*a*, 22*b*, and 22*c*. In other words, the axes of the small-diameter hole sections 23*a*, 23*b*, and 23*c* are eccentric to those of the large-diameter hole sections 22*a*, 22*b*, and 22*c* in a range of $R-r<P<R+r$, where R indicates the radius of the large-diameter hole sections 22*a*, 22*b*, and 22*c*, r indicates the radius of the small-diameter hole sections 23*a*, 23*b*, and 23*c*, and P indicates the shift distance between the axes of the large-diameter hole sections 22*a*, 22*b*, and 22*c* and those of the small-diameter hole sections 23*a*, 23*b*, and 23*c* (see FIG. 8). Therefore, the resonator holes 2*a*, 2*b*, and 2*c* have bent shapes.

As shown in FIG. 8, the distance d3 between the axes of the small-diameter hole sections 23*a* and 23*c* is set shorter than the distance d4 between the axes of the large-diameter hole sections 22*a* and 22*c*, and is set shorter than the distance between the axes of the small-diameter hole sections in the conventional dielectric filter. The distance d5 between the axes of the small-diameter hole sections 23*b* and 23*c* is set longer than the distance d6 between the axes of the large-diameter hole sections 22*b* and 22*c*, and is set longer than in the conventional dielectric filter.

Figure 9:
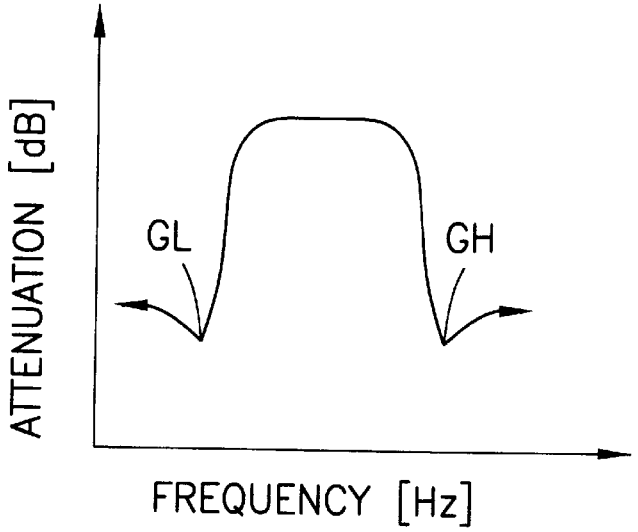
FIG. 9 is a graph showing the attenuation characteristic of the dielectric filter shown in FIG. 7.

In the dielectric filter having this structure, the coupling between two resonators formed of the resonator holes 2*a* and 2*c* is of a strong inductive type, and the coupling between resonators formed of the resonator holes 2*b* and 2*c* is of a strong capacitive type. Therefore, as shown in FIG. 9, the attenuation characteristic of the filter has one attenuation pole GL at the lower-frequency side of the passband and one attenuation pole GH at the higher-frequency side of the passband. Thus, the width of the passband is made larger by making the distance d3 between the axes of the small-diameter hole sections 23*a* and 23*c* shorter, and by making the distance d5 between the axes of the small-diameter hole sections 23*b* and 23*c* longer.

Figure 10:
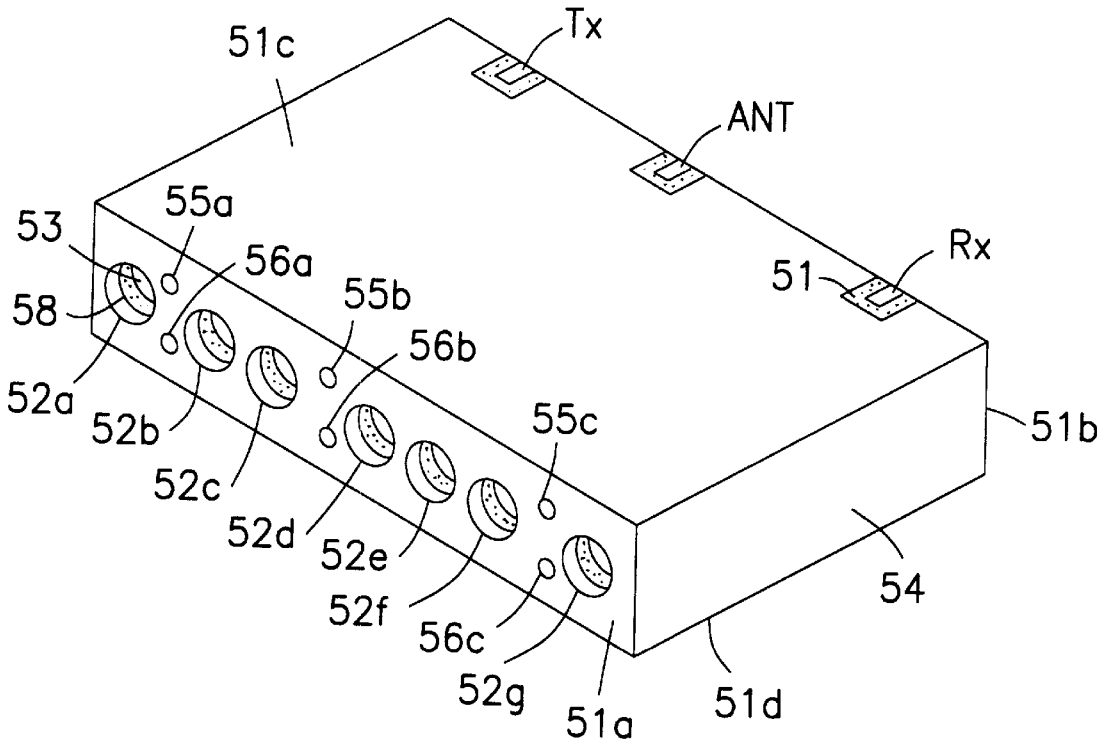
FIG. 10 is an external perspective view of a dielectric duplexer according to a fifth embodiment of the present invention.
Figure 11:
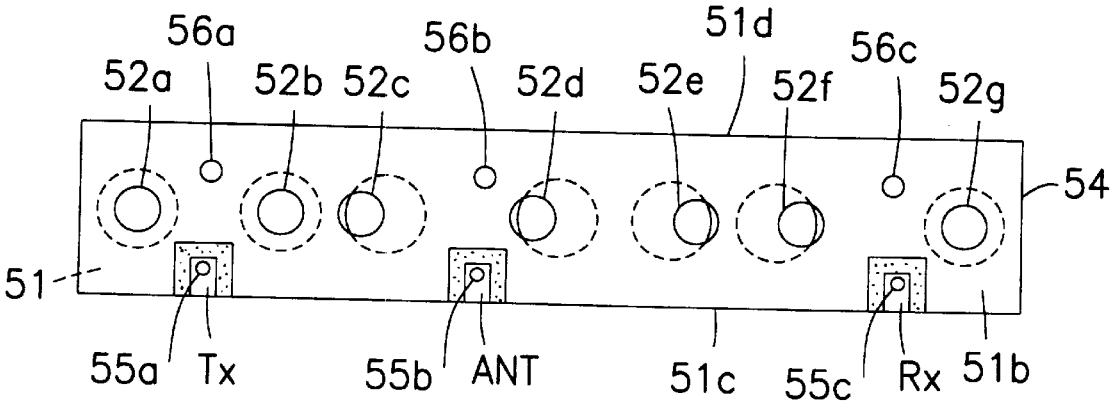
FIG. 11 is a view of a short-circuited end face of the dielectric duplexer shown in FIG. 10.
Figure 12:
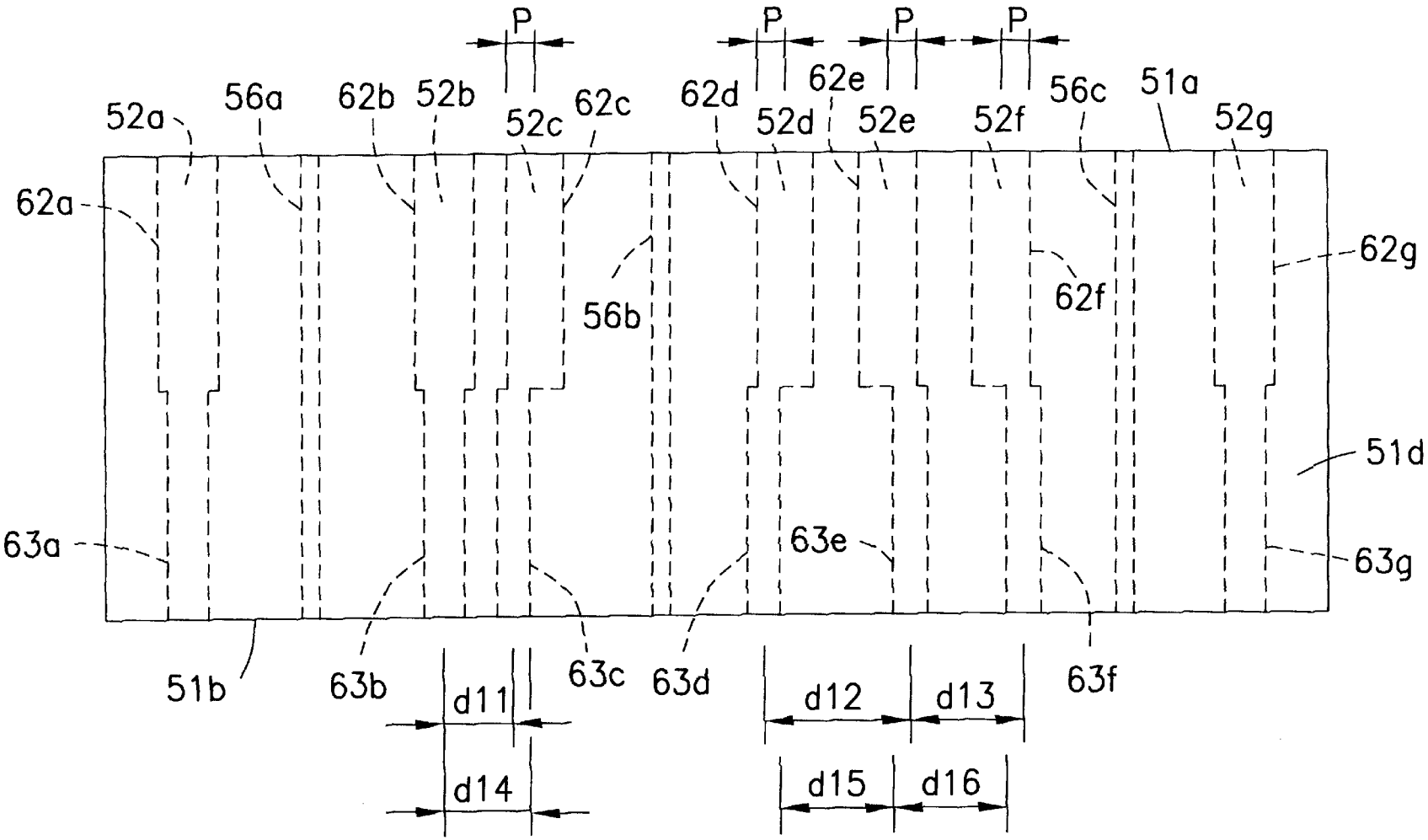
FIG. 12 is a plan view of the dielectric duplexer shown in FIG. 11.

Fifth Embodiment (FIG. 10 to FIG. 12)

The fifth embodiment is a dielectric duplexer which can be used for a mobile communication apparatus such as a car phone or a mobile phone. FIG. 10 is an external perspective view of a dielectric duplexer viewed from the side of an end face 51*a*, indicating a mounting surface (bottom surface) 51*c* as seen from above. FIG. 11 is a view from the side of an end face 51*b*, indicating the mounting surface 51*c* at the bottom of the figure. FIG. 12 is a plan view of the dielectric duplexer shown in FIG. 11.

In this dielectric duplexer, seven resonator holes 52*a*–52*g* passing through a pair of opposite end surfaces 51*a*, 51*b* of a dielectric block 51 having substantially parallelepiped shape are formed in line. External coupling holes 55*a*, 55*b* and 55*c* and grounding holes 56*a*, 56*b* and 56*c* are formed between resonator holes 52*a* and 52*b*, 52*c* and 52*d*, and 52*f* and 52*g*, respectively.

The resonator holes 52*a*–52*g* respectively include large-diameter hole sections 62*a*–62*g* having a circular transverse cross-section and small-diameter hole sections 63*a*–63*g* having a circular transverse cross-section and connecting to the large-diameter hole sections 62*a*–62*g*. The axes of the small-diameter hole sections 63*c*–63*f* are eccentrically shifted from those of the large-diameter hole sections 62*c*–62*f*. The axes of the small-diameter hole sections 63*c*–63*f* are shifted away from those of the large-diameter hole sections 62*c*–62*f* by a distance in a range defined by $R-r<P<R+r$, where R indicates the radius of the large-diameter hole sections 62*c*–62*f*, r indicates the radius of the small-diameter hole sections 63*c*–63*f*, and P indicates the shift distance between the axes of the large-diameter hole sections 62*c*–62*f* and those of the small-diameter hole sections 63*c*–63*f* (see FIG. 12). Therefore, the resonator holes 52*c*–52*f* have bent shapes.

As shown in FIG. 12, the distance d14 between the axes of the small-diameter hole sections 63*a* and 63*c* is narrower than the distance d14 between the axes of the large-diameter hole sections 62*b* and 62*c*, and is set narrower than the distance between the axes of the small-diameter hole sections in the conventional dielectric filter. The distance d12 between the axes of the small-diameter hole sections 63*d* and 63*e* is wider than the distance d15 between the axes of the large-diameter hole sections 62*d* and 62*e*, and is set wider than the distance between the axes of the small-diameter hole sections in the conventional dielectric filter. The distance d13 between the axes of the small-diameter hole sections 63*e* and 63*f* is equal to the distance d16 between the axes of the large-diameter hole sections 62*e* and 62*f*, and is set equal to the distance between the axes of the small-diameter hole sections in the conventional dielectric filter.

Almost all of the outer surface of the dielectric block 51 is covered with an outer conductor 54. A transmission electrode Tx and a reception electrode Rx serving as input/output electrodes and an antenna electrode ANT are formed on the dielectric block 51 with a distance maintained around them such that the electrodes are not electrically connected to the outer conductor 54. The input/output electrodes extend from the mounting surface 51*c* to the end surface 51*b*.

Inner conductors 53 (shown in FIG. 10) are formed on almost the entire inner peripheral surfaces of the respective resonator holes 52*a*–52*g*. Non-conducting portions 58 are formed between the inner conductors 53 and the outer conductor 54 and extend into openings of the respective large-diameter hole sections 62*a*–62*g*. The end surface 51*a* having the openings of the large-diameter sections 62*a*–62*g* with non-conducting portions 58 is the open-circuited end, and the end surface 51*b* having the openings of the small-diameter sections 63*a*–63*g* is the short-circuited end. The inner conductors 53 are electrically open (separated) from the outer conductor 54 at the open-circuited end 51*a*, and is electrically short-circuited (connected) to the outer conductor 54 at the short-circuited end 51*b*. The axial length of the resonator holes 52*a*–52*g* is set to $\lambda/4$ (where $\lambda$ indicates the central wavelength of a resonator formed in each of the resonator holes 52*a*–52*g*).

Inner conductors 53 are formed on the entire inner peripheral surfaces of the external coupling holes 55*a*, 55*b* and 55*c* and the grounding holes 56*a*, 56*b* and 56*c*. The external coupling holes 55*a*, 55*b* and 55*c* are respectively connected to the transmission electrode Tx, the antenna electrode ANT, and the reception electrode Rx at the short-circuited end 51*b* and electrically separated from the outer conductor 54. On the other hand, the inner conductors 53 of the respective external coupling holes 55*a*–55*c* are electrically connected to the outer conductor 54 at the open-circuited end 51*a*.

On the other hand, the grounding holes 56*a*–56*c* are respectively provided in the vicinity of the external coupling holes 55*a*–55*c* in parallel fashion. The inner conductors of the respective grounding holes 56*a*–56*c* are electrically connected to the outer conductor 54 at both the open-circuited end 51*a* and the short-circuited end 51*b*. The self capacitance of each of the external coupling holes 55*a*–55*c* can be increased or decreased by changing the location, shape and dimensions of each of the grounding holes 56*a*–56*c*. Therefore, the external coupling can be changed to thereby obtain the appropriate external coupling. Note that the self capacitance of each of the external coupling holes 55*a*–55*c* is the capacitance generated between the inner conductors 53 of the respective external coupling holes 55*a*–55*c* and the grounding conductors (the outer conductor 54 and the inner conductor 53 of each of the grounding holes 56*a*–56*c*).

This dielectric duplexer comprises a transmission filter (band pass filter) having two resonators formed by the resonator holes 52*b* and 52*c*, a reception filter (band pass filter) having three resonators formed by the resonator holes 52*d*, 52*e* and 52*f*, and two traps (band elimination filters) having resonators formed by the resonator holes 52*a*, 52*g* located at both sides. The external coupling hole 55*a* and the adjacent resonator holes 52*a* and 52*b*, the external coupling hole 55*b* and the adjacent resonator holes 52*c* and 52*d*, and the external coupling hole 55*c* and the adjacent resonator holes 52*f* and 52*g* are electromagnetically coupled to each other respectively. External coupling is obtained by this electromagnetic coupling.

In the above described dielectric duplexer, a transmission signal from a transmission circuit (not shown in the drawings) to the transmission electrode Tx is output from the antenna electrode ANT via the transmission filter having the resonator holes 52*b* and 52*c*, and a reception signal from the antenna electrode ANT is output to a reception circuit (not shown in the drawings) via the reception filter having the resonator holes 52*d*, 52*e*, 52*f* and the reception electrode Rx. And, the coupling between the two resonators formed of the resonator holes 52*b*, 52*c* is of a strong inductive type, and the coupling between the two resonators formed of the resonator holes 52*d*, 52*e* is of a strong capacitive type. Therefore, a dielectric duplexer having a strong inductive coupling or capacitive coupling is obtained without changing the external shape and dimensions of the dielectric block 51.

When the distance d1 between the axes of the small-diameter hole sections 63*e* and 63*f* of the resonator holes 52*e* and 52*f* is set equal to the distance d16 between the axes of the large-diameter hole sections 62*e* and 62*f*, electromagnetic coupling between the two resonators formed of the resonator holes 52*e*, 52*f* is kept constant to thereby obtain a higher degree of freedom in designing the dielectric duplexer.

In addition, the attenuation pole formed at the lower frequency side (or the higher frequency side) of the passband can be moved in the lower-frequency direction (or the higher-frequency direction). A compact dielectric filter having high performance and a steep attenuation characteristic can readily be made with a wider passband.

Other Embodiments

A dielectric filter and a dielectric duplexer according to the present invention are not limited to those described in the above embodiments. They can be changed within the scope of the invention.

Figure 13:
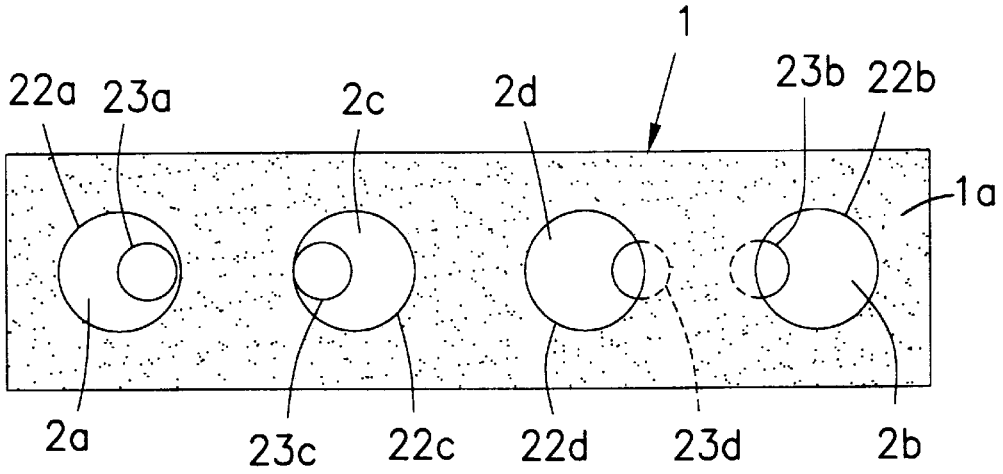
FIG. 13 is an end view of a dielectric filter according to a sixth embodiment of the present invention.

According to a sixth embodiment, shown in FIG. 13, for example, four resonator holes 2*a*, 2*b*, 2*c*, and 2*d* may be formed in the dielectric block 1. In this case, the resonator holes 2*a* and 2*c* are formed such that the axes of the small-diameter hole sections 23*a* and 23*c* are shifted with respect to those of the large-diameter hole sections 22*a* and 22*c* by a distance in a range defined by $0<P\leqq R-r$, where R indicates the radius of the large-diameter hole sections 22*a* to 22*d*, r indicates the radius of the small-diameter hole sections 23*a* to 23*d*, and P indicates the shift distance between the axes of the large-diameter hole sections 22*a* to 22*d* and those of the small-diameter hole sections 23*a* to 23*d*. The resonator holes 2*b* and 2*d* are formed such that the axes of the small-diameter hole sections 23*b* and 23*d* are shifted with respect to those of the large-diameter hole sections 22*b* and 22*d* by a distance in a range defined by R−r<P<R+r.

The coupling between two resonators formed in each of the resonator holes 2*a* and 2*c* is of a strong inductive type, and the coupling between two resonators formed in each of the resonator holes 2*c* and 2*d* is of a strong capacitive type. Two resonators formed at each of the resonator holes 2*b* and 2*d* are inductively coupled stronger than the inductive coupling between the resonator holes 2*a* and 2*c*. Therefore, the degree of freedom in designing the electromagnetic coupling in a dielectric filter can be further increased, and a band-pass filter and a duplexer can also be readily designed. Five resonator holes may be provided.

The axial length of a resonator hole is not limited to λ/4. It may be λ/2, for example. In this case, both opening surfaces of a resonator hole need to be short-circuit end faces or open end faces.

Figure 14:
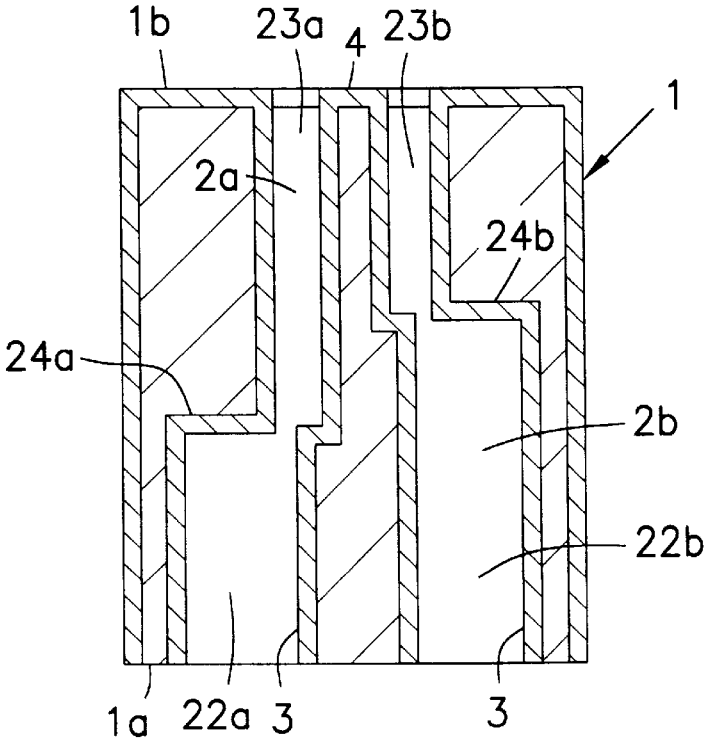
FIG. 14 is a horizontal cross-section of a dielectric filter according to a seventh embodiment of the present invention.

As shown in FIG. 14, in a seventh embodiment, the boundary step sections 24*a* and 24*b* between the large-diameter hole sections 22*a* and 22*b* and the small-diameter hole sections 23*a* and 23*b* in resonator holes 2*a* and 2*b* are not necessarily disposed at the same position in the axial direction, and may be disposed at different positions in the axial direction of the resonator holes 2*a* and 2*b*.

Figure 15:
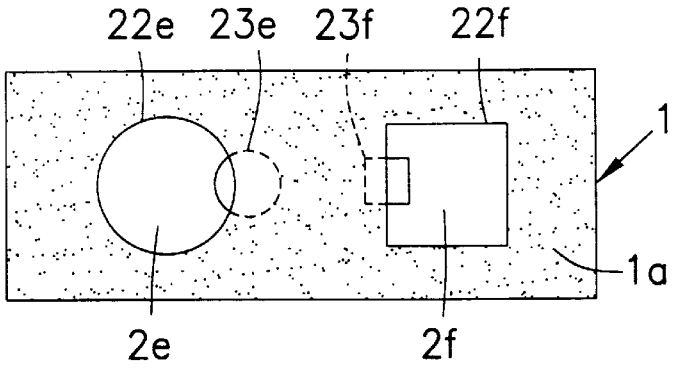
FIG. 15 is an end view of a dielectric filter according to an eighth embodiment of the present invention.

As shown in an eighth embodiment in FIG. 15, the shapes of the large-diameter hole sections 22*e* and 22*f* and the small-diameter hole sections 23*e* and 23*f* of resonator holes 2*e* and 2*f* may be rectangular in transverse cross-section as well as circular.

Figure 16:
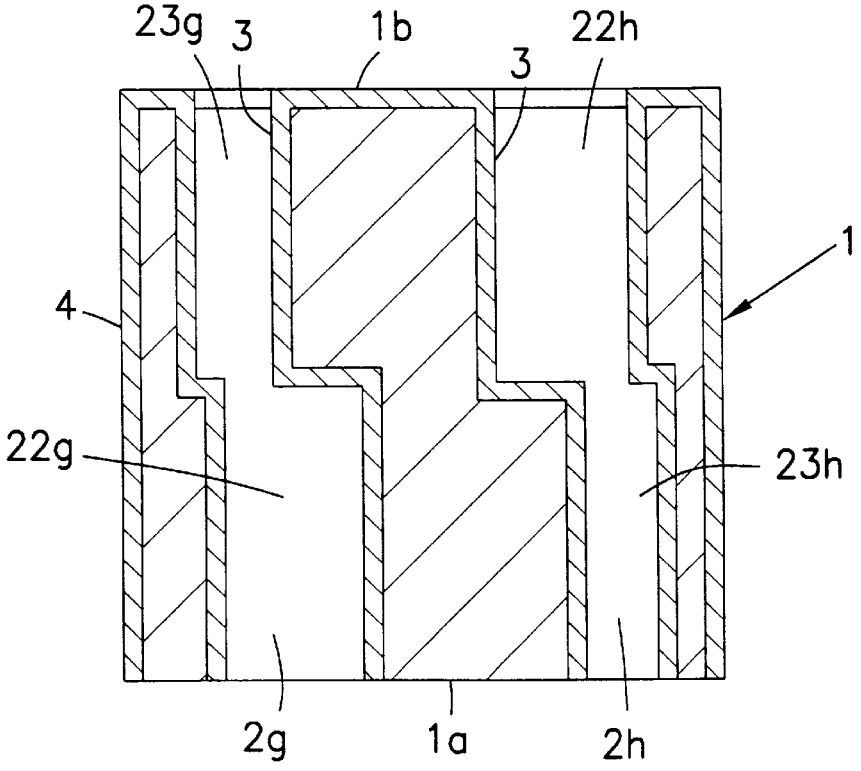
FIG. 16 is a horizontal cross-section of a dielectric filter according to a ninth embodiment of the present invention.
Figure 18:
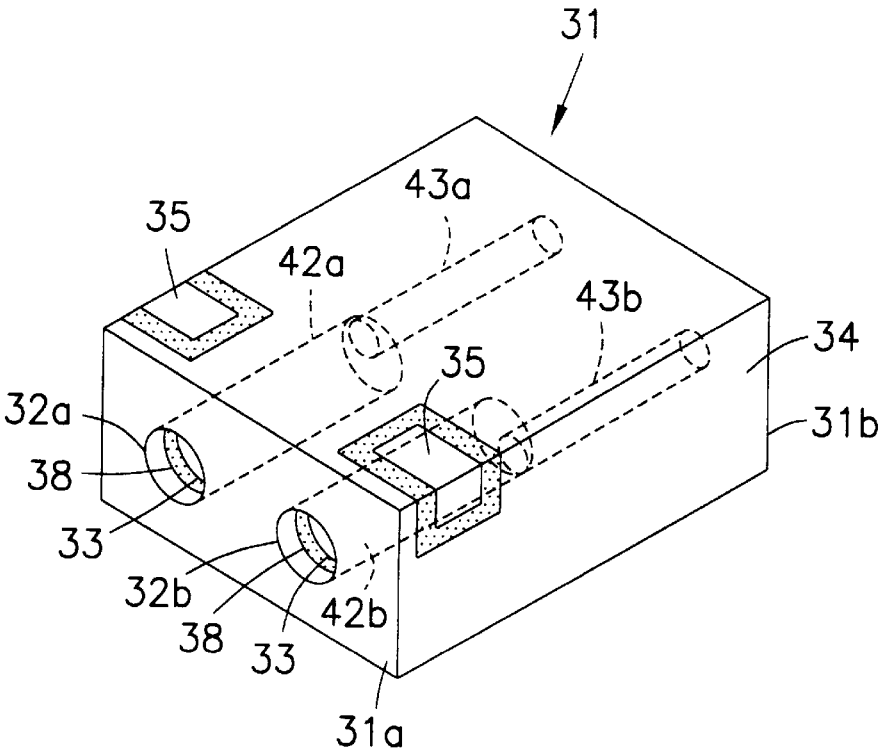
Fig. 18 PRIOR ART
FIG. 18 is an external perspective view of a conventional dielectric filter.

As shown in a ninth embodiment in FIG. 16, the large-diameter hole sections 22*g* and 22*h* and the small-diameter hole sections 23*g* and 23*h* of resonator holes 2*g* and 2*h* may be formed such that the large-diameter hole section 22*g* is disposed near an open end face 1*a* and the small-diameter hole section 23*g* is disposed near a short-circuit end face 1*b*, while the small-diameter hole section 23*h* is disposed near the open end face 1*a* and the large-diameter hole section 22*h* is disposed near the short-circuit end face 1*b*.

Figure 17:
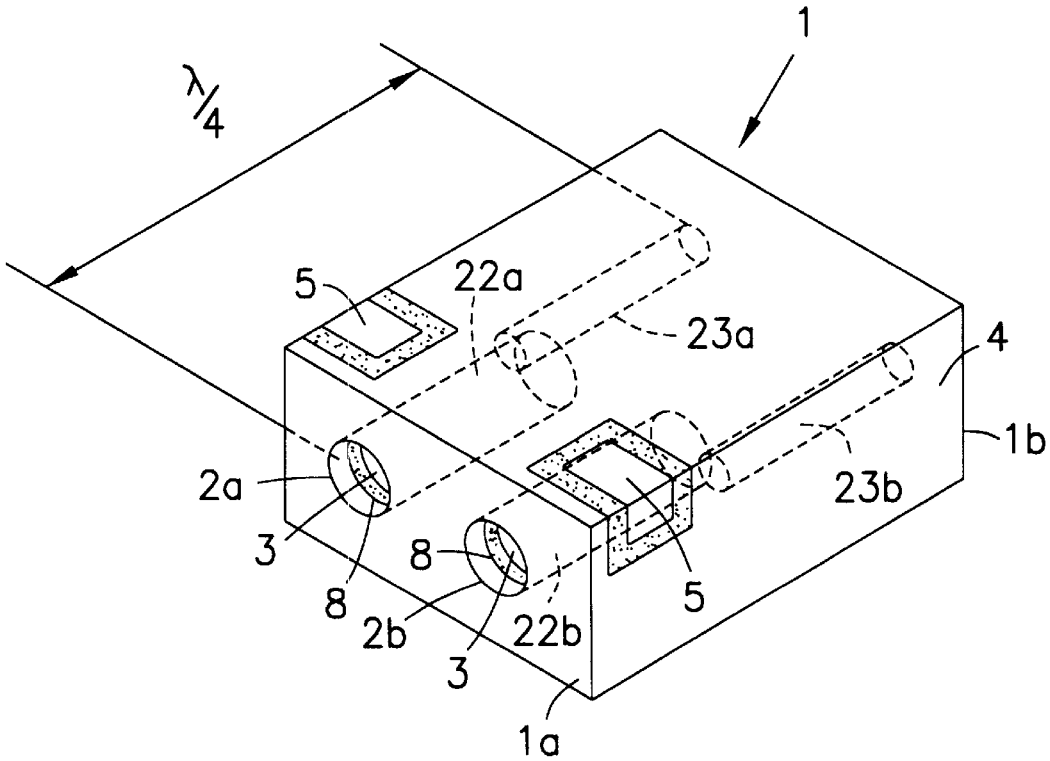
FIG. 17 is an external perspective view of a dielectric filter according to a tenth embodiment of the present invention.

A dielectric filter according to a tenth embodiment may be formed as shown in FIG. 17. In this dielectric filter, an outer conductor 4 is formed on almost all of the outer surface of a dielectric block 1.

One pair of input and output electrodes 5 is formed on the outer surface of the dielectric block 1. The electrodes 5 are not electrically connected to the outer conductor 4 because of a gap maintained between them.

Inner conductors 3 are formed on almost the entire surface inside the resonator holes 2*a* and 2*b*. Gaps 8 are provided between the inner conductors 3 and the portion of the outer conductor 4 extending into the openings of the large-diameter hole sections 22*a* and 22*b*. An open end face 1*a* is adjacent to the large-diameter hole sections 22*a* and 22*b* on which the gaps 8 are provided, and a short-circuit end face 1*b* is adjacent to the small-diameter hole sections 23*a* and 23*b*. The axial length of the inner conductors 3 of the resonator holes 2*a* and 2*b* is set to λ/4.

A dielectric filter and a dielectric duplexer may include a resonator hole having a constant inner diameter. A dielectric filter may be configured with another electromagnetic coupling structure such as a coupling groove provided in a dielectric block in order to greatly change the level of coupling.

In the above embodiments, the large-diameter hole sections are usually formed near the open end face and the small-diameter hole sections are formed near the short-circuit end face in the resonator holes. The structure of the resonator holes is not limited to this structure. Resonator holes may be configured such that large-diameter hole sections are formed near the short-circuit end face, and wherein the distance between the axes of small-diameter hole sections formed near the open end face is changed. In this case, the coupling relationship between adjacent resonator holes is opposite that described in the above embodiments. In other words, as the distance between the axes of the small-diameter hole sections is reduced, the level of capacitive coupling gradually becomes strong. As the distance between the axes of the small-diameter hole sections is extended, the level of inductive coupling becomes strong.

In the above embodiments, input/output coupling is provided by the pair of input and output electrodes on the outer surface of the dielectric block in the dielectric filter. However, instead of the input and output electrodes, a resin pin may be used to connect the dielectric filter to an external circuit.

In the above embodiments, the axes of the small-diameter hole sections are shifted from the axes of the large-diameter hole sections, which are disposed at a specified pitch. However, instead, the axes of the large-diameter hole sections may be shifted from the axes of the small-diameter hole sections, which are disposed at the specified pitch.

In the above embodiments, the axes of the large-diameter hole sections and the small-diameter hole sections are arranged in line in the resonator holes. Instead, however, the axes of the large-diameter hole sections and those of the small-diameter hole sections may be disposed, for example, in a zigzag pattern at different positions in the height direction of a dielectric filter.

While the invention has been particularly shown and described with reference to embodiments thereof, it will be understood by those skilled in the art that the foregoing and other changes in form and details may be made therein without departing from the spirit of the invention.

What is claimed is:

1. A dielectric filter, comprising a dielectric block, a plurality of resonator holes provided inside the dielectric block, inner conductors provided on the inner surfaces of the plurality of resonator holes, and an outer conductor formed on the outer surface of the dielectric block, wherein at least one of the plurality of resonator holes has a large-diameter hole section having an axis and a small-diameter hole section having an axis, said small-diameter hole section being connected to said large-diameter hole section, wherein the axis of said large-diameter hole section is shifted by a shift distance P from the axis of said small-diameter hole section to form a bent-shaped hole, and wherein a radius R of said large-diameter hole section, a radius r of said small-diameter hole section, and the shift distance P between the axis of said large-diameter hole section and the axis of said small-diameter hole section satisfy the expression R−r<P<R+r.

2. The dielectric filter according to claim 1, comprising a pair of adjacent bent-shaped resonator holes, wherein the distance between the axes of the small-diameter hole sections in the pair of adjacent resonator holes is longer than the distance between the axes of the large-diameter hole sections in said pair of adjacent resonator holes.

3. The dielectric filter according to claim 1, comprising a pair of adjacent bent-shaped resonator holes, wherein the distance between the axes of the small-diameter hole sections in the pair of adjacent resonator holes is shorter than the distance between the axes of the large-diameter hole sections in said pair of adjacent resonator holes.

4. A dielectric filter according to claim 1, comprising a pair of adjacent bent-shaped resonator holes, wherein the distance between the axes of the small-diameter hole sections in the pair of adjacent resonator holes is equal to the distance between the axes of the large-diameter hole sections in said pair of adjacent resonator holes.

5. A dielectric duplexer, comprising a dielectric block, first and second pluralities of resonator holes provided inside the dielectric block for providing said duplexer with at least first and second filters, inner conductors provided on the inner surfaces of the first and second pluralities of resonator holes, and an outer conductor formed on the outer surface of the dielectric block, wherein at least one resonator hole among said first and second pluralities of resonator holes has a large-diameter hole section having an axis and a small-diameter hole section having an axis, said small-diameter hole section being connected to said large-diameter hole section, wherein the axis of said large-diameter hole section is shifted from the axis of said small-diameter hole section by a shift distance P to form a bent-shaped hole, and wherein a radius R of said large-diameter hole section, a radius r of said small-diameter hole section, and the shift distance P between the axis of said large-diameter hole section and the axis of said small-diameter hole section satisfy the expression $R-r<P<R+r$.

6. The dielectric duplexer according to claim 5, wherein a pair of the bent-shaped resonator holes are formed adjacently, and the distance between the axes of the small-diameter hole sections in the pair of adjacent resonator holes is longer than the distance between the axes of the large-diameter hole sections in said pair of adjacent resonator holes.

7. The dielectric duplexer according to claim 5, wherein a pair of the bent-shaped resonator hole are formed adjacently, and the distance between the axes of the small-diameter hole sections in the pair of adjacent resonator holes is shorter than the distance between the axes of the large-diameter hole sections in said pair of adjacent resonator holes.

8. A dielectric duplexer according to claim 5, wherein a pair of the bent-shaped resonator holes are formed adjacently, and the distance between the axes of the small-diameter hole sections in the pair of adjacent resonator holes is equal to the distance between the axes of the large-diameter hole sections in said pair of adjacent resonator holes.

9. The dielectric filter according to claim 2, comprising another pair of adjacent bent-shaped resonator holes, wherein the distance between the axes of the small-diameter hole sections in said another pair of adjacent resonator holes is shorter than the distance between the axes of the large-diameter hole sections in said first-mentioned pair of adjacent resonator holes.

10. The dielectric duplexer according to claim 6, comprising another pair of adjacent bent-shaped resonator holes, wherein the distance between the axes of the small-diameter hole sections in said another pair of adjacent resonator holes is shorter than the distance between the axes of the large-diameter hole sections in said first-mentioned pair of adjacent resonator holes.

11. The dielectric filter according to claim 1, wherein said dielectric block has an open end face which is substantially free of said outer conductor adjacent to said resonator hole inner conductors, said large-diameter hole section being disposed adjacent to said open end face.

12. The dielectric filter according to claim 1, wherein at least one of said plurality of resonator holes has an open end defined by a gap between the inner conductor thereof and said outer conductor, and said gap is formed in said large-diameter hole section of said at least one resonator hole.

13. The dielectric duplexer according to claim 5, wherein at least one of said plurality of resonator holes has an open end defined by a gap between the inner conductor thereof and said outer conductor, and said gap is formed in said large-diameter hole section of said at least one resonator hole.

14. The dielectric filter according to claim 1, comprising a pair of bent-shaped resonator holes, wherein a respective boundary is defined between the large-diameter and small-diameter hole sections in each of said pair of resonator holes, and said boundaries are disposed at different positions along the corresponding axes of said pair of resonator holes.

15. The dielectric filter according to claim 1, comprising a pair of bent-shaped resonator holes, wherein said large-diameter hole sections thereof have different shapes.

16. The dielectric filter according to claim 15, wherein said small-diameter hole sections of said pair of resonator holes have different shapes.

17. The dielectric filter according to claim 1, comprising a pair of bent-shaped resonator holes, wherein said small-diameter hole sections of said pair of resonator holes have different shapes.

* * * * *